US006958709B2

(12) United States Patent
Izbicki et al.

(10) Patent No.: US 6,958,709 B2
(45) Date of Patent: Oct. 25, 2005

(54) METHOD, SYSTEM, AND STORAGE MEDIUM FOR INTEGRATING VEHICLE MANAGEMENT, TRANSPORTATION AND COMMUNICATIONS FUNCTIONS

(75) Inventors: Michael Paul Izbicki, Bedford, NH (US); Leonard Frederick Schmidt, III, Metairie, LA (US); Carl Martin Buck, Framingham, MA (US)

(73) Assignee: General Electric Company, Schenectady, NY (US)

( * ) Notice: Subject to any disclaimer, the term of this patent is extended or adjusted under 35 U.S.C. 154(b) by 82 days.

(21) Appl. No.: 10/631,454

(22) Filed: Jul. 30, 2003

(65) Prior Publication Data

US 2004/0088104 A1 May 6, 2004

Related U.S. Application Data

(60) Provisional application No. 60/401,917, filed on Aug. 8, 2002.

(51) Int. Cl.[7] ..... G08G 1/123
(52) U.S. Cl. ..... 340/994; 701/201
(58) Field of Search ..... 340/994, 989, 340/991; 701/23, 25, 26, 201

(56) References Cited

U.S. PATENT DOCUMENTS

| | | | | |
|---|---|---|---|---|
| 5,623,413 | A | 4/1997 | Matheson et al. | |
| 5,696,503 | A * | 12/1997 | Nasburg | 340/933 |
| 5,818,979 | A | 10/1998 | Fujiwara | |
| 5,850,617 | A * | 12/1998 | Libby | 701/202 |
| 5,973,619 | A * | 10/1999 | Paredes | 340/994 |
| 6,240,362 | B1 * | 5/2001 | Gaspard, II | 701/209 |
| 6,459,964 | B1 | 10/2002 | Vu et al. | |
| 6,700,506 | B1 * | 3/2004 | Winkler et al. | 340/994 |
| 6,714,859 | B2 * | 3/2004 | Jones | 701/201 |
| 6,754,634 | B1 * | 6/2004 | Ho | 705/6 |
| 2002/0129104 | A1 | 9/2002 | Trossen | |

* cited by examiner

*Primary Examiner*—John Tweel, Jr.
(74) *Attorney, Agent, or Firm*—Cantor Colburn LLP

(57) ABSTRACT

A vehicle management system includes a vehicle location system providing location information indicative of a location of a vehicle. A integrated transportation management tool is coupled to the vehicle location system and receives the location information. The integrated transportation management tool initiates a course of action in response to the location information. The course of action may include altering at least one of speed, capacity and route of the vehicle. Passenger information may also be used by the integrated transportation management tool to determine the course of action. Multiple integrated transportation management tools may be coupled by a network to provide distributed management of vehicles.

21 Claims, 5 Drawing Sheets

METHOD, SYSTEM, AND STORAGE MEDIUM FOR INTEGRATING VEHICLE MANAGEMENT, TRANSPORTATION AND COMMUNICATIONS FUNCTIONS

CROSS-REFERENCE TO RELATED APPLICATIONS

This application claims the benefit of U.S. provisional patent application No. 60/401,917 filed Aug. 8, 2002, the entire contents of which are incorporated herein by reference.

BACKGROUND OF THE INVENTION

The present invention relates generally to vehicle management and control systems for the transportation of passengers, and more particularly, the invention relates to a method, system, and storage medium for facilitating vehicle scheduling and achieving high quality of service for passengers by coordinating the movement of passengers awaiting transit vehicles and the movement of vehicles to carry them. The invention may be implemented with personal vehicles, in a transportation system for loading and unloading passengers among vehicles at a station, and among vehicles of various modes of transportation.

Mass transit systems have been around for years and are used for transporting passengers and/or goods from one location to another. Automobiles, passenger trains, commercial bus lines, and airlines are common forms of human transportation. Over the years, advancements in various technologies have led to increased operational efficiencies in these systems. For example, satellite technology and global positioning system (GPS) devices installed on system vehicles assist in tracking their locations in real time.

One area for improvement in the operation for transportation systems is scheduling. Scheduling a vehicle such as a passenger train or subway car involves complex planning capabilities and dynamic variables that must be assessed and factored into the scheduling decisions (e.g., the length of the route to be covered by the vehicle, its optimum speed, expected passenger loading, scheduled maintenance times, efficient allocation of a shared track or path, to name a few). These scheduling issues are compounded when considering the number of vehicles available for scheduling as well as unexpected delays that can materialize with little or no warning, and the unpredictability of the passengers themselves, whose travel patterns shift such as in response to emergencies or other unexpected or unplanned events. Complexities increase for inter-modal transportation stations, such as an airport terminal served by planes, buses, commuter rail and even long distance rail transit.

Thus, even sophisticated scheduling systems may not be immune from the difficulties likely to result from the occurrence of any of the above variables. What is needed therefore is a way to monitor passenger loading and the status of the various vehicles in transit, identify and examine disparities in passenger transportation needs, vehicle scheduling and current vehicle locations, and provide alternative solutions to vehicle scheduling and to passengers and/or customers in a near real time mode of operation.

BRIEF DESCRIPTION OF THE INVENTION

A feature of the invention is a transit vehicle management system for coordinating movement of passengers and vehicles to carry them. The system includes a vehicle location system providing location information indicative of a location of a transit vehicle for carrying passengers. A passenger status system monitors the passengers awaiting arrival of the vehicle at a station and generates passenger information indicative of a number of passengers waiting. An integrated transportation management tool is in communication with the vehicle location system and the passenger status system. The integrated transportation management tool receives the location information and passenger information indicative of a number of passengers awaiting the vehicle. The integrated transportation management tool initiates a course of action relative to the vehicle or the passengers in response to the location information and the passenger information.

Another feature of the invention is a distributed transit vehicle management system for coordinating movement of passengers and vehicles to carry them. The system includes a vehicle location system providing information indicative of a location and status of a transit vehicle in the system. A first substation includes a first integrated transportation management tool for managing a first set of vehicles of a first transportation mode. A network is coupled to the first integrated transportation management tool. A second substation includes a second integrated transportation management tool coupled to the network. The second integrated transportation management tool manages a second set of vehicles of a second transportation mode. The first and second integrated transportation management tools are in communication with the vehicle location system and receive vehicle location and status information. The integrated transportation management tools initiates a course of action in response to the location information. The course of action alters at least one of schedule, speed, capacity and route of the vehicles at one station in light of the vehicle location and status information at the other station.

Another feature of the invention is a method for coordinating movement of passengers and transit vehicles to carry them. The method includes obtaining location information indicative of a location of a transit vehicle for carrying passengers using a vehicle location system. Passengers awaiting arrival of the vehicle at a station are monitored and passenger information indicative of a number of passengers waiting is generated using a passenger status system. A course of action relative to the vehicle or the passengers is automatically initiated in response to the location information and the passenger information.

Another feature of the invention is a storage medium encoded with machine-readable computer program code for coordinating movement of passenger and transit vehicles to carry them. The storage medium includes instructions for causing a computer system to implement obtaining location information from a vehicle location system indicative of a location of a transit vehicle for carrying passengers. Passenger information is obtained from a passenger status system indicative of a number of passengers awaiting arrival of the vehicle at a station. A course of action relative to the vehicle or the passengers is automatically initiated in response to the location information and the passenger information.

BRIEF DESCRIPTION OF THE DRAWINGS

Referring now to the figures, which are exemplary embodiments, and wherein like elements are numbered alike.

DETAILED DESCRIPTION OF THE INVENTION

An integrated transportation management tool of this invention provides system integration of a variety of transit software applications. By integrating these assets, transportation systems are able to continuously track transit vehicles and revise schedules in order to automatically accommodate changing conditions, including passenger loading conditions. In one embodiment, the tool conveys status information relating to vehicles in transit to passengers in substations as well as to coordinate and communicate transportation alternatives. The term vehicle as used herein refers to any form of transportation including transit vehicles such as trains, buses, watercraft, aircraft, and personal vehicles (e.g., cars, motorcycles).

Figure 1:
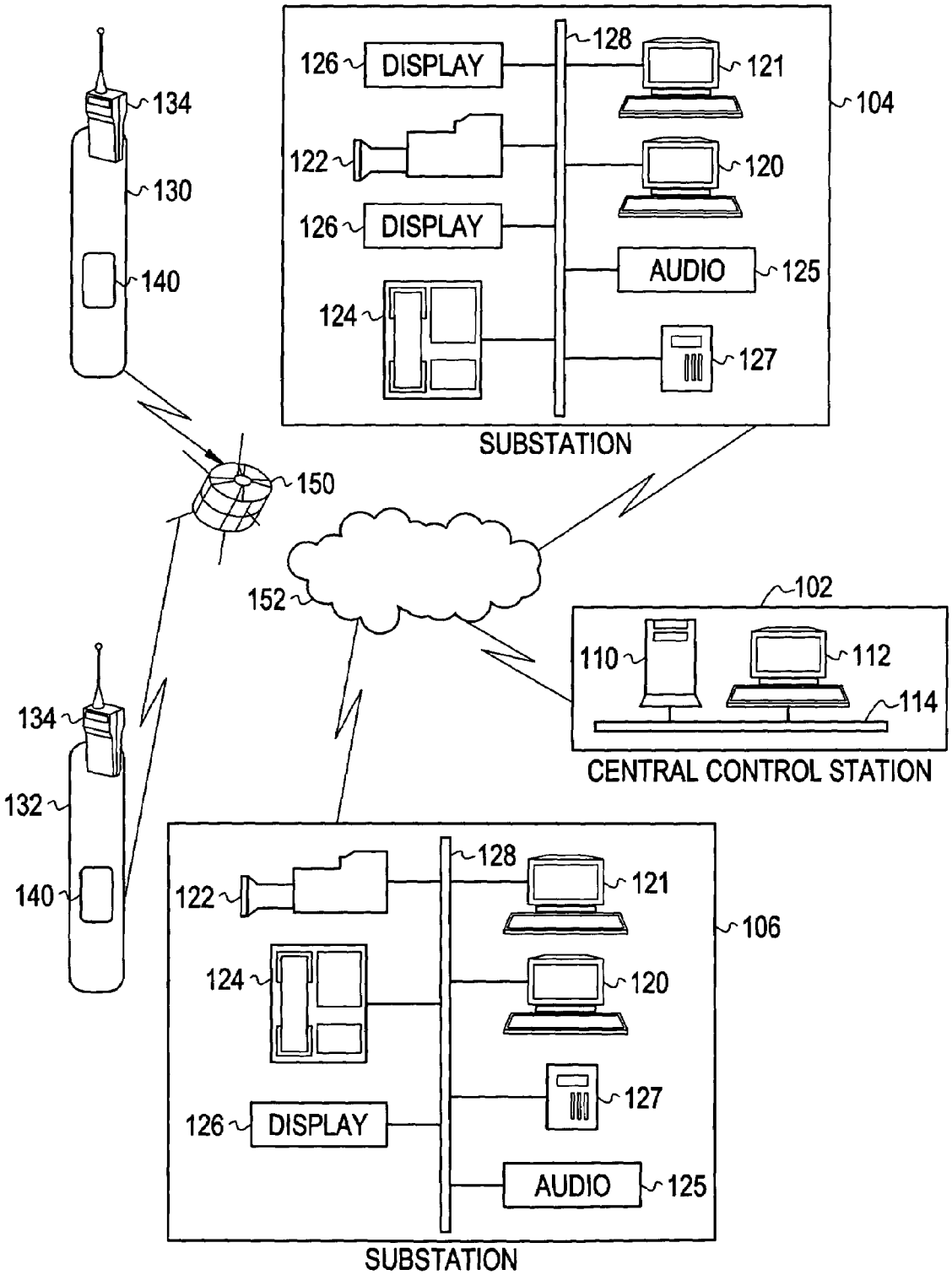
FIG. 1 is a system diagram of a computer network system upon which an integrated transportation management tool of this invention is implemented in an exemplary embodiment.

The system of FIG. 1 includes a central control station 102, and two substations 104 and 106. The substations are part of a primarily single mode (or may be multi-mode) transit stations such as train terminals, airline terminals, bus terminals, subway terminals, etc. Each of substations 104 and 106 includes a computer system that implements the integrated transportation management tool. Central control station 102 may also execute the integrated transportation management tool but also performs additional supervisory functions and assistance to substations 104 and 106. The control functions may be executed in a centralized or distributed, decentralized manner to provide redundancy. Substations 104 and 106 and central control station 102 communicate via a network 152 which may be any suitable type of network (e.g., WAN, Internet, VPN, WIFI etc.).

Central control system 102 includes a server 110, a client system 112, and a network link 114 providing communications between the two. Server 110 may be a high-speed data processing device with web and applications server software. Server 110 executes the integrated transportation management tool among other business applications. Client system 112 may be a general-purpose computer processor such as a desktop or similar device. Client system 112 communicates with server 110 via network link 114. Components of each of substations 104 and 106 include client systems 120, a passenger status system (e.g., closed circuit television (CCTV) cameras) 122, a telephone/facsimile/intercom system 124, a public address system including one or more display signs 126 and an audio-based (PA) message system 125, a wireless transmission component 127 (e.g., radio, cellular, etc.), and a communications link 128 (e.g., LAN) which allows these components to communicate with each other. Each substation 102 and 104 also includes a server 121 that executes the integrated transportation management tool described herein. These components are described in more detail with reference to FIG. 2 herein.

Also included in system 100 are a plurality of transportation vehicles, which may be of the same mode of transportation or differing modes of transportation, with two such vehicles being shown at 130 and 132 (e.g., bus, train, subway car, etc.) in FIG. 1. Each of the vehicles operate through one or more transportation systems affiliated with substations 104 and/or 106. Transportation vehicles 130 and 132 include wireless communications devices 134 for contacting substations associated with these vehicles. Also included in transportation vehicles 130 and 132 are suitable tracking systems, such as global positioning system (GPS) devices 140, for providing accurate location data. The vehicles communicate their locations to vehicle location systems in substations 104, 106 and/or central control system 102 via any suitable wireless communications techniques, such as satellites 150 or cellular phones.

In an alternate embodiment, some or all of the functions performed by central control station 102 may be incorporated into one or both of substations 104 and 106, eliminating the need for central control of operations. This may be desirable for smaller transportation facilities such as a local bus station.

Figure 2:
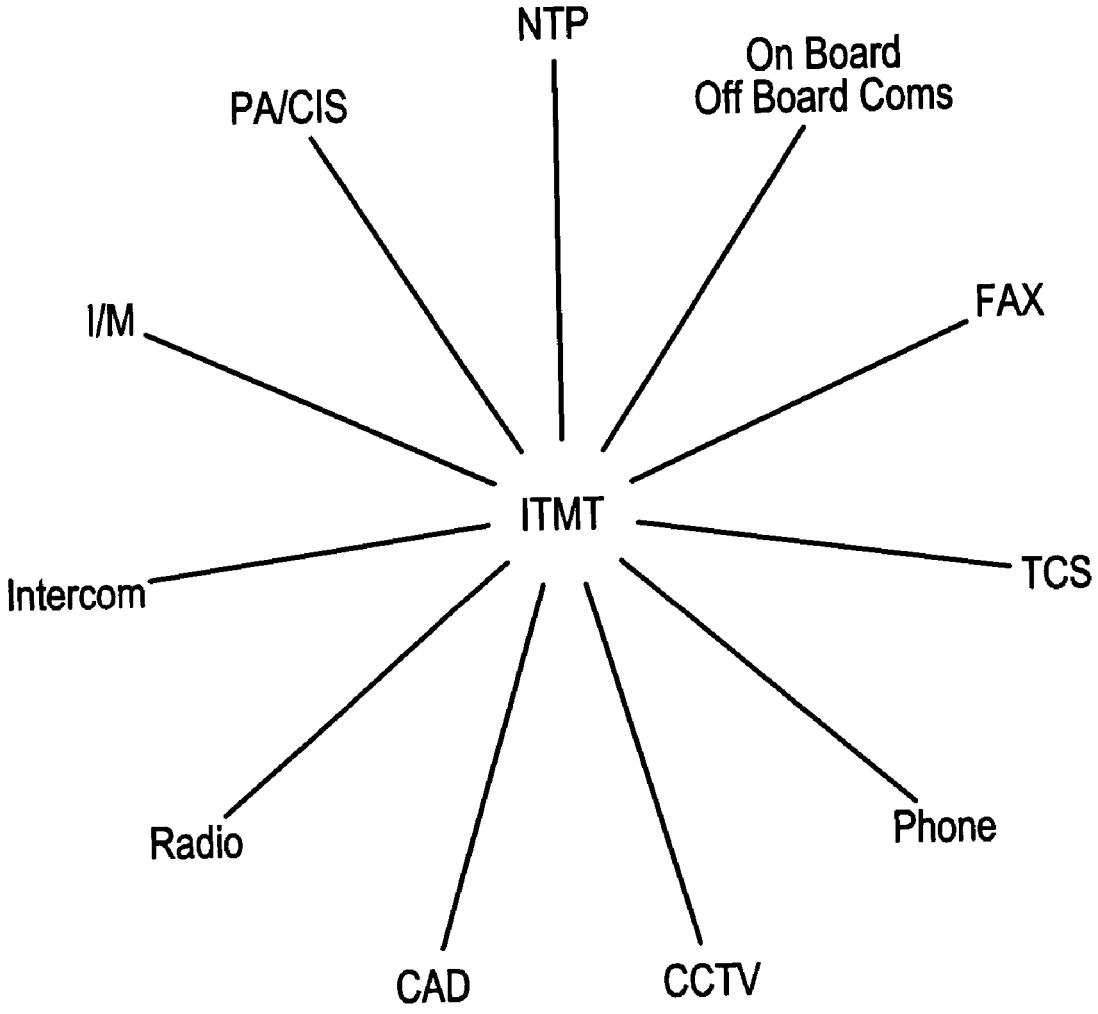
FIG. 2 is a block diagram of system components of the integrated transportation management system.
Figure 3:
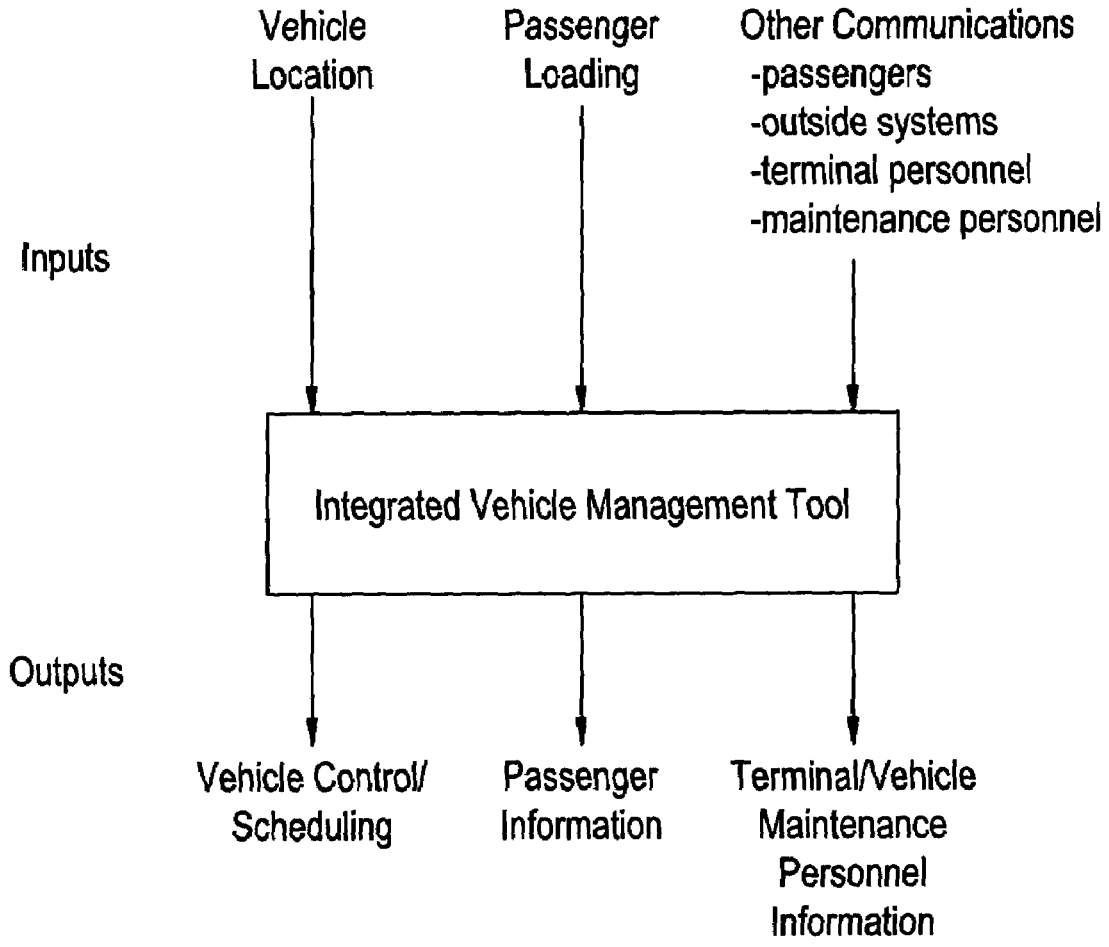
FIG. 3 is a block diagram of the inputs and outputs of the system for monitoring passenger loading and vehicle status, and to inform passengers and/or control vehicle operation and schedules.

FIGS. 2 and 3 illustrate the components of the system in further detail. FIG. 2 includes a central integrated transportation management tool (ITMT) that interfaces with a variety of subsystems. The subsystems may be implemented through software or a combination or software and hardware. The subsystems include a public address/customer information system (PA/CIS) that provides information to passengers in the terminal through displays 126 and audio system 125. A network time protocol (NTP) provides for time synchronization for the subsystems. A centralized traffic control system (TCS) provides information concerning the location of vehicles, status, departure location and time, arrival location and time, etc.

The on board/off board communications system provides for communication with operators of vehicles. A facsimile subsystem (FAX) provides for sending and receiving facsimiles. A phone system provides phone service within the substation. A suitable real-time (or near real-time) monitor of the passenger loading status, such as close circuit television (CCTV) system having cameras 122 (FIG. 2), is provided. The CCTV cameras 122 may be directed to areas where passengers accumulate such as bus stops, train station platforms, subway stops, etc. As described in further detail, the CCTV cameras are part of a passenger status system for monitoring passengers and provides passenger information concerning the number of passengers waiting which is used to dictate corrective measures.

A computer aided dispatch (CAD) system provides information about the schedule, status (such as location) and estimated time of arrival of the transportation vehicles. A suitable communication system such as a radio system provides for communication with substation personnel (e.g., maintenance employees), substation security personnel, transportation vehicle operators, dispatchers, etc. The intercom system provides for passenger communications with substation personnel. For example, an emergency intercom may be placed at each train platform. Parking areas may also be provided with intercoms. A suitable text messaging system, such as an instant messaging (IM) system allows ad hoc messages to be generated over the PA/CIS. The instant messaging system is used for non-routine messaging such as the announcement of a lost item.

The integrated transportation management tool (ITMT), may include a suite of integrated tools including a Vehicle Management Tool, Customer Management Tool, Driver Management Tool, SCADA (System I/O, Customer I/O, External System I/O), Schedule Management Tool, Route Management Tool, Front End Processor Tool, Passenger Information Management Tool, Communication Management Tool, Data Management Tool, as well as other system specific management tools (e.g., for Emergency Ventilation Tool, Rail Electrification). Together the ITMT integrates the data and services of these tools providing improved vehicle operations and increased customer quality of service.

FIG. 3 illustrates exemplary inputs to and outputs from the integrated transportation management tool. As shown, the integrated transportation management tool implemented on server 121 receives inputs from a vehicle location system, a passenger status system, and other communication sources such as passengers and substation personnel. Outputs generated by the integrated transportation management tool include information related to vehicle control/scheduling (e.g., updating schedule system), passenger information (e.g., text/audio messaging), and terminal/vehicle maintenance (e.g., notices to maintenance personnel to perform corrective action).

The ITMT may provide all the tools for providing the services required for an entire system, or the ITMT can work with existing systems provided by others. For example, existing SCADA/Centralized Train Control systems may interface with the ITMT Customer Management Tool. Existing Vehicle Scheduling systems may interface with the ITMT Vehicle Management Tool and the ITMT Customer Management Tool. Existing PA/CIS systems may interface with the ITMT Customer Management Tool.

ITMT Vehicle Management Tool may provide advanced vehicle location, tracking and routing functions. For example, if a vehicle is not reporting (e.g., communication outage, lack of reporting capability), the Vehicle Management Tool executes estimation and/or simulation routines to predict vehicle location. The Vehicle Management Tool may also provide operator-to-vehicle scheduling to match available operators with vehicles. Vehicle control may also be provided by the Vehicle Management Tool to establish speed and/or route of vehicles. Such vehicle control may be performed automatically by interfacing with a vehicle control system and/or through a controller and/or by communicating with a vehicle operator.

The ITMT also provides a variety of passenger information by delivering timely and accurate and informative transportation system, or related data to the customers of the vehicle system. The delivery method may be a public address audio, electronic message boards, and other forms of information delivery. The customer information is not limited to outgoing information, but also incoming information, such as surveillance video, customer aid stations and phones. The system's ability to inform the customers of correct and up to date vehicle schedules, changes, and other transportation system related information provides high quality of service.

The ITMT Data Management Tool provides real-time integration of system inputs and outputs along with any simulations and/or estimations where real-time information is absent. Vehicle position information may be estimated and/or simulated may be based on last known vehicle position, route conditions, time elapsed, etc.

Figure 4:
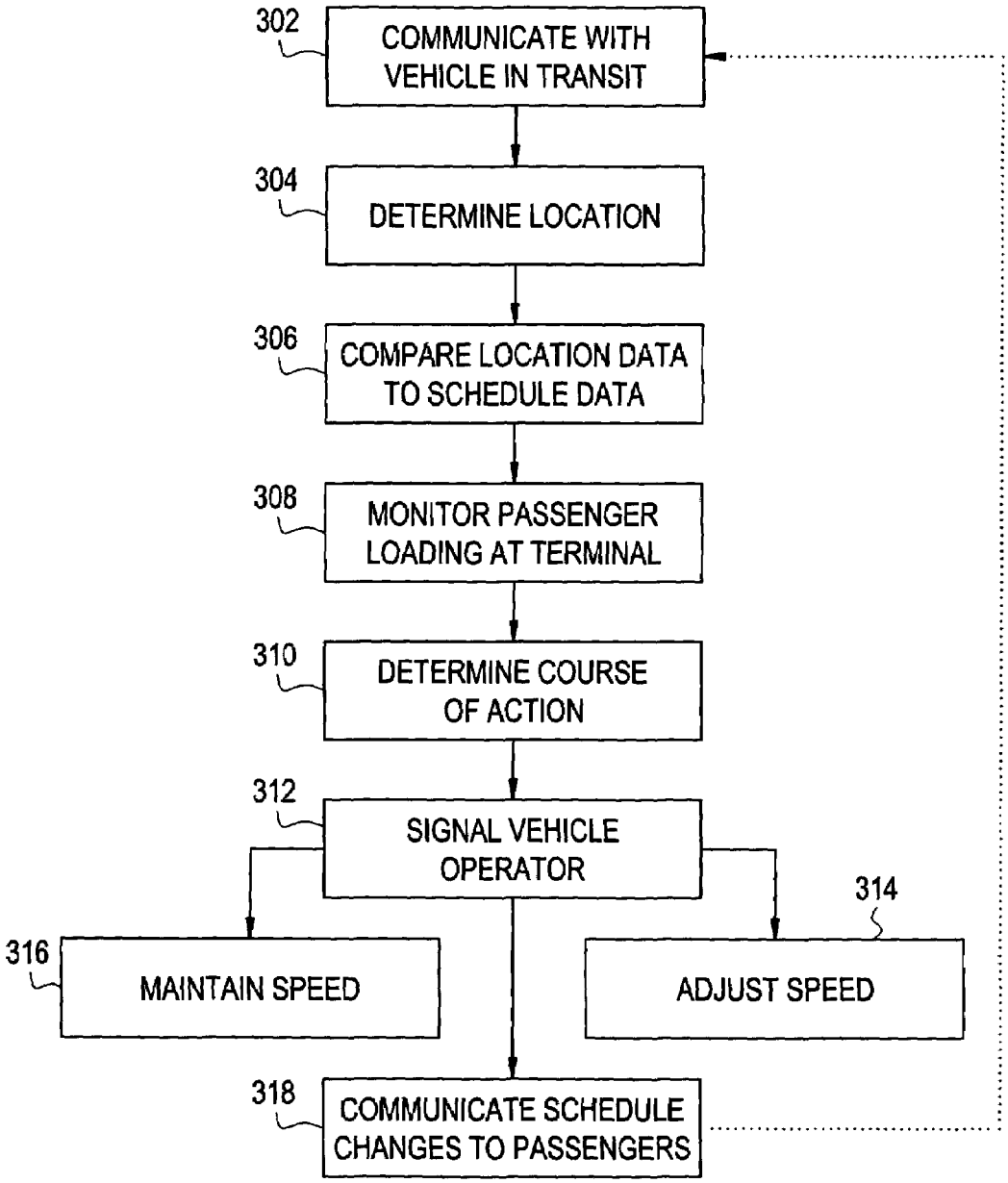
FIG. 4 is a flowchart illustrating the process of managing vehicle scheduling methods via the integrated transportation management tool in a first embodiment.

In one aspect of the invention, the integrated transportation management tool facilitates scheduling functions and resolves conflicts as described in FIG. 4. The process may start at step 302 where a transportation vehicle 132 is signaled to determine the location of the transportation vehicle. The signaling may be initiated manually by an operator or automatically by the integrated transportation management tool. The GPS device 140 on transportation vehicle 132 transmits data to substation 104 and the vehicle location is determined at step 304. The order of these steps may be reversed.

The vehicle location and status data are automatically compared to schedule data maintained by the TCS at step 306 in order to determine if vehicle 132 is currently on schedule. Utilizing predictive analysis tools, the integrated transportation management tool can evaluate this data and determine the estimated time of arrival for the vehicle.

Based on the TCS, the arrival location of the transportation vehicle 132 is automatically determined. A signal is then transmitted, for example, to activate the CCTV 122 at the area where passengers are waiting on vehicle 132 at step 308. An image of the area where the passengers are waiting is retrieved and analyzed to determine an estimate of the number of passengers waiting for transportation vehicle 132. The determination of the number of passengers may be performed by a human and input to the integrated transportation management tool. Alternatively, the integrated transportation management tool may automatically determine the number of passengers and input the data. The CCTV image may be compared to a reference image (e.g., an empty platform) to estimate the number of passengers. More differences between the reference image and the current image indicates more passengers.

A course of action is determined either by human involvement, the integrated transportation management tool, or a combination of the above at step 310 utilizing the information received from steps 306 and 308. The course of action may involve changing speed of the vehicle, increasing capacity of the vehicle, altering the route of the vehicle, etc. For example, suppose that vehicle 132 is predicted to arrive 20 minutes late. A snapshot from CCTV 122 indicates that a crowd of waiting passengers has gathered at the substation 104 waiting for its arrival. The course of action may include automatically signaling the operator of vehicle 132 at step 312 via the wireless transmission component 127 or suitable communications channel and requesting that the operator of vehicle 132 increase speed to a specified level at step 314 in order to compensate for the loss of time. Alternatively, a vehicle control system on vehicle 132 may be directly instructed to alter speed, change route or alter capacity. The operator may also be notified to alter route or alter capacity by adding another car to the train to accommodate the number of passengers. If necessary, steps 302–314 may be repeated periodically and automatically (e.g., once per minute), with the sequence then being changed and steps repeated or eliminated, as necessary.

Determining a course of action at step 310 includes determining the presence of conflicts with potential courses of action and eliminating courses of action that conflict with other conditions. For example, a course of action to alter a route for a vehicle may conflict with a system requirement for keeping a route open at all times for emergency situations.

If the CCTV 122 at substation 104 reveals that very few passengers are waiting, the course of action at step 310 may include automatically signaling the operator of vehicle 132 to maintain the course at step 316 resulting in no changes to the operation of the vehicle. In either event, a signal may be automatically transmitted to the substations' public address system comprising audio system 125 and displays 126 at substation 104. The integrated transportation management tool includes standard notices in both text and audio format. The integrated transportation management tool retrieves standard text and/or audio notices and provides the notices to displays and/or the audio system. The public address system provides information to waiting passengers such as the expected time of arrival for vehicle 132 at step 318.

The notices generated by the integrated transportation management tool may also be accessed outside of the substation. Such notices may be stored on server 121 and accessed by a variety of techniques such as by phone, Internet, PDA, instant messaging, etc.

The process of FIG. 4 provides for automated, real-time analysis of vehicle and passenger conditions to determine whether an action is needed. The course of action may include signaling the vehicle operator to increase speed and/or capacity, or schedule more vehicles or alternative forms of transportation, such as buses for a train terminal. The course of action may also include using the public address system to notify passengers of the situation and direct them to alternative routes.

Figure 5:
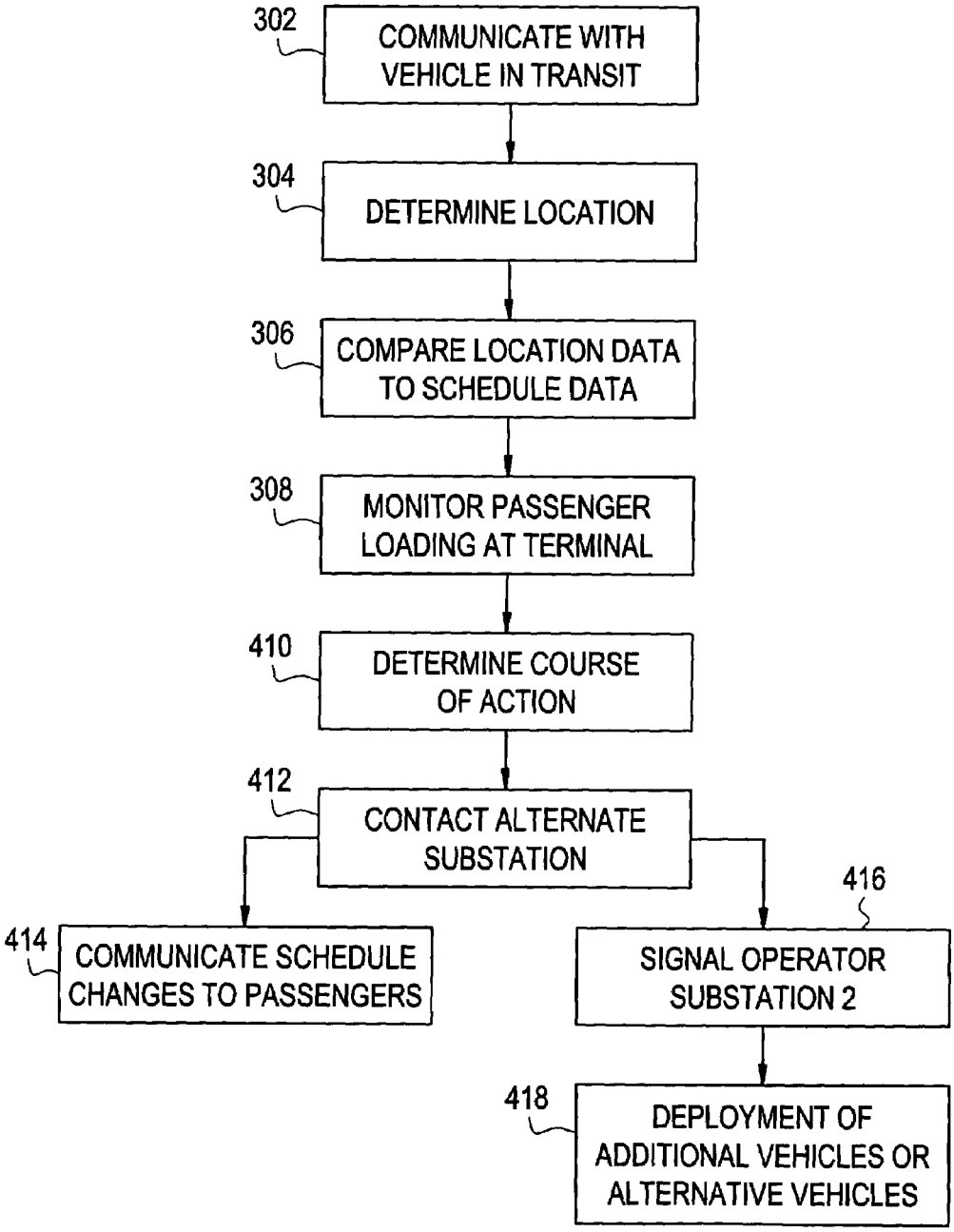
FIG. 5 is a flowchart illustrating the process of managing vehicle scheduling methods via the integrated transportation management tool in a second embodiment.

In an alternative embodiment, the integrated transportation management tool facilitates scheduling functions and conflicts as described in FIG. 5. Steps 302–308 of FIG. 5 are similar to those in FIG. 4. At step 410, a course of action is determined either by human involvement, the integrated transportation management tool, or a combination based on the information received from steps 306 and 308. For example, suppose that a transportation vehicle has broken down as evidenced by no change in position of the vehicle of interest over several cycles of updating the status of the transportation schedule. A snapshot from CCTV 122 indicates that a crowd of waiting passengers has gathered at the station waiting for arrival of the transportation vehicle. The course of action may include contacting an alternative transportation substation 106 for assistance and passenger diversion at step 412. The servers 121 executing the integrated transportation management tool communicate over network 152.

Server 121 at substation 106 receives the request and determines if any vehicles may be distributed to substation 104. This determination may be made based on vehicle locations (vehicles located or due to arrive at substation 106) provided by the GPS devices, vehicle status provided by the TCS and passenger requirements provided by the CCTV system. For example, if server 121 determines that high number of passengers are waiting based on the passenger status system, then vehicles may not be available for substation 104. Conversely, if vehicles are available at substation 106, these vehicles may be directed to substation 104.

If the alternate transportation substation 106 is equipped to handle the overflow, it replies affirmatively to the originating substation 104 which then signals the relevant public address system at step 414 in order to inform the waiting passengers of the alternative vehicle. The operator of transportation vehicle 132 at substation 106 is notified that a change in schedule has been determined at step 416 and transportation vehicle 132 is deployed to the new location at step 418. The integrated transportation management tool at substations 104 and 106 will also update the relevant subsystems (e.g., TCS schedule) to reflect routing of vehicle 132 to substation 104.

The integrated transportation management tool allows transportation systems to continuously track vehicles and revise schedules in order to accommodate changing conditions. The tool further provides a means to convey status information relating to vehicles in transit to passengers in substations as well as to coordinate and communicate transportation alternatives.

The transportation vehicles and the substations may be of different types. For example, substation 106 may be a bus station and substation 104 a train station. Thus, if a train is not operational, buses may be automatically routed to the train station to accommodate the passengers.

Other conditions may be detected or predicted and trigger a course of action by the integrated transportation management tool. Conditions that would cause a vehicle schedule/route change, or modification to operation of vehicle (e.g., speed restrictions) include conditions such as a passenger emergency in the path of the vehicle (e.g., 911 call made from upcoming platform), maintenance in the path of the vehicle, disaster in the path of the vehicle (e.g., fire, crash, weather), obstruction in the path of the vehicle (e.g., congestion, disabled vehicle), passenger loading, vehicles conflicting for the same path, special events and vehicle loading. When such conditions are detected or predicted by the integrated transportation management tool a course of action may be initiated by the integrated transportation management tool.

The determined course of action may involve notifying support personnel in addition to managing passenger and/or vehicle movement. For example, if additional vehicles are needed, maintenance personnel may be notified to perform vehicle preparation on the additional vehicles. The integrated transportation management tool may initiate such communication with the support personnel.

The integrated transportation management tool provides passengers with notices which may vary depending on the mode of transportation. For example, for bus, train and ferries, such notices may include travel alerts (e.g., ambler alert), emergency alerts, maintenance alerts, parking lot full/empty, on time/late messages, schedule recovery alerts/actions, vehicle congestion alerts. For personal vehicles (e.g., automobiles) such notices may include travel alerts (e.g., ambler alert), emergency alerts, maintenance alerts, travel lane alerts, speed advisory, disaster advisory, vehicle congestion alerts, parking lot full/empty, mobile electronic signs and bus/train alerts (for transfers at passenger stations). For aircraft/airline applications, such notices may include passenger gate info (for incoming traffic), travel alerts (e.g., ambler alert), traffic/rail alerts (for transfers to rail and road at airports).

As described above, the present invention can be embodied in the form of computer-implemented processes and apparatuses for practicing those processes. The present invention can also be embodied in the form of computer program code containing instructions embodied in tangible media, such as floppy diskettes, CD-ROMs, hard drives, or any other computer-readable storage medium, wherein, when the computer program code is loaded into and executed by a computer, the computer becomes an apparatus for practicing the invention. The present invention can also be embodied in the form of computer program code, for example, whether stored in a storage medium, loaded into and/or executed by a computer, or transmitted over some transmission medium, such as over electrical wiring or cabling, through fiber optics, or via electromagnetic radiation, wherein, when the computer program code is loaded into and executed by a computer, the computer becomes an apparatus for practicing the invention. When implemented on a general-purpose microprocessor, the computer program code segments configure the microprocessor to create specific logic circuits.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed for carrying out this invention.

What is claimed is:

1. A transit vehicle management system for coordinating movement of passengers and vehicles to carry them comprising:

a vehicle location system providing location information indicative of a location of a transit vehicle for carrying passengers;

a passenger status system for monitoring said passengers awaiting arrival of said vehicle at a station and generating passenger information indicative of a number of passengers waiting;

an integrated transportation management tool in communication with said vehicle location system and said passenger status system, said integrated transportation management tool receiving said location information and passenger information indicative of a number of passengers awaiting said vehicle;

said integrated transportation management tool initiating a course of action relative to said vehicle or said passengers in response to said location information and said passenger information.

2. The vehicle management system of claim 1 wherein:

said passenger status system comprises cameras for monitoring said passengers.

3. The vehicle management system of claim 1 wherein:

said course of action includes revising a vehicle schedule in response to said location information and said passenger information.

4. The vehicle management system of claim 1 wherein:

said course of action includes initiating a public address system in response to said location information and said passenger information.

5. The vehicle management system of claim 1 wherein:

said course of action includes initiating communications with said vehicle in response to said location information and said passenger information.

6. The vehicle management system of claim 5 wherein:

said course of action includes sending an instruction to alter speed.

7. The vehicle management system of claim 5 wherein:

said course of action includes sending an instruction to increase capacity.

8. The vehicle management system of claim 1 wherein:

said course of action includes initiating communications with a vehicle control system in response to said location information to automatically alter at least one of speed, capacity and route of said vehicle.

9. The vehicle management system of claim 1 wherein:

said integrated transportation management tool detects or predicts a condition, said course of action being determined in response to said location information and said condition.

10. A method for coordinating movement of passengers and transit vehicles to carry them comprising:

obtaining location information indicative of a location of a transit vehicle for carrying passengers using a vehicle location system;

monitoring said passengers awaiting arrival of said vehicle at a station and generating passenger information indicative of a number of passengers waiting using a passenger status system;

automatically initiating a course of action relative to said vehicle or said passengers in response to said location information and said passenger information.

11. The method of claim 10 wherein:

said course of action includes revising a vehicle schedule in response to said location information and said passenger information.

12. The method of claim 10 wherein:

said course of action includes initiating a public address system in response to said location information and said passenger information.

13. The method of claim 10 wherein:

said course of action includes initiating communications with a vehicle in response to said location information and said passenger information.

14. The method of claim 13 wherein:

said course of action includes sending an instruction to alter speed.

15. The method of claim 13 wherein:

said course of action includes sending an instruction to increase capacity.

16. The method of claim 10 wherein:

said course of action includes initiating communications with a vehicle control system in response to said location information to automatically alter at least one of speed, capacity and route of said vehicle.

17. The method of claim 10 wherein:

said location information and said passenger information are determined based on a vehicle arriving at a first substation and passengers at said first substation;

said course of action being implemented at a second substation, said course of action altering at least one of schedule, speed, capacity and route of said vehicles at said second station in light of said vehicle location information and said passenger information at said first station.

18. The method of claim 17 wherein:

said first substation is directed to vehicles of a first transportation mode and said second substation is directed to vehicles of a second transportation made;

said second transportation mode is different from said first transportation mode.

19. The method of claim 18 wherein:

said first transportation mode is train and said second transportation mode is bus.

20. The method of claim 18 wherein:

said course of action includes generating a request for an additional vehicle from said second substation for delivery to said first substation.

21. A storage medium encoded with machine-readable computer program code for coordinating movement of passengers and transit vehicles to carry them, the storage medium including instructions for causing a computer system to implement:

obtaining location information from a vehicle location system indicative of a location of a transit vehicle for carrying passengers;

obtaining passenger information from a passenger status system indicative of a number passengers awaiting arrival of said vehicle at a station;

automatically initiating a course of action relative to said vehicle or said passengers in response to said location information and said passenger information.

* * * * *